US010040657B2

(12) United States Patent
Osada

(10) Patent No.: US 10,040,657 B2
(45) Date of Patent: Aug. 7, 2018

(54) SHEET CONVEYANCE APPARATUS AND IMAGE FORMING APPARATUS

(71) Applicant: CANON KABUSHIKI KAISHA, Tokyo (JP)

(72) Inventor: Takehito Osada, Susono (JP)

(73) Assignee: CANON KABUSHIKI KAISHA, Tokyo (JP)

( * ) Notice: Subject to any disclaimer, the term of this patent is extended or adjusted under 35 U.S.C. 154(b) by 0 days.

(21) Appl. No.: 15/623,795

(22) Filed: Jun. 15, 2017

(65) Prior Publication Data

US 2017/0283197 A1 Oct. 5, 2017

Related U.S. Application Data

(63) Continuation of application No. 14/972,367, filed on Dec. 17, 2015, now Pat. No. 9,718,633.

(30) Foreign Application Priority Data

Dec. 25, 2014 (JP) ..... 2014-262997

(51) Int. Cl.
*B65H 5/36* (2006.01)

(52) U.S. Cl.
CPC ..... *B65H 5/36* (2013.01); *B65H 2402/441* (2013.01); *B65H 2402/64* (2013.01); *B65H 2404/513* (2013.01); *B65H 2404/611* (2013.01)

(58) Field of Classification Search
CPC ..... B65H 5/36; B65H 29/00; B65H 2402/45; B65H 2402/53; B65H 2404/50; B65H 2404/74; B65H 2404/741; B65H 2404/7412; B65H 2404/7414; B65H 5/062; B65H 5/26; B65H 5/38; B65H 2404/611; B65H 2402/64; B65H 2404/513; B65H 2402/441
See application file for complete search history.

(56) References Cited

U.S. PATENT DOCUMENTS

| | | | |
|---|---|---|---|
| 5,265,869 | A | 11/1993 | Morita |
| 8,807,556 | B2 | 8/2014 | Sugiyama et al. |
| 8,811,857 | B2 | 8/2014 | Fukunaga et al. |
| 9,102,483 | B2 | 8/2015 | Osada et al. |
| 2004/0041339 | A1 | 3/2004 | Choi |

(Continued)

FOREIGN PATENT DOCUMENTS

| | | | |
|---|---|---|---|
| JP | 2001-19177 | A | 1/2001 |
| JP | 2013-028465 | A | 2/2013 |

*Primary Examiner* — David H Bollinger
(74) *Attorney, Agent, or Firm* — Fitzpatrick, Cella, Harper & Scinto

(57) ABSTRACT

A sheet conveyance apparatus includes a sheet conveyor, a conveyance guide, and a door arranged movably between an open and closed position and configured to press the conveyance guide to move it from a guide open position to a guide closed position. A first retainer engages the conveyance guide so as to retain the conveyance guide, and a second retainer disposed in a position different from the first retainer engages the conveyance guide so as to retain the conveyance guide. When the door is positioned at the closed position, the first and second retainers retain, in different positions, the conveyance guide at the guide closed position, and when the door is positioned at the open position, the first retainer maintains the conveyance guide at the guide closed position and the second retainer releases a retention of the conveyance guide at the guide closed position.

14 Claims, 11 Drawing Sheets

(56) References Cited

U.S. PATENT DOCUMENTS

| | | | |
|---|---|---|---|
| 2004/0175210 | A1 | 9/2004 | Otaka |
| 2007/0057448 | A1 | 3/2007 | Hiura |
| 2008/0296837 | A1 | 12/2008 | Jowett et al. |
| 2009/0121416 | A1 | 5/2009 | Tashiro et al. |
| 2014/0147183 | A1 | 5/2014 | Koshida |
| 2015/0261166 | A1 | 9/2015 | Takahashi et al. |

SHEET CONVEYANCE APPARATUS AND IMAGE FORMING APPARATUS

This application is a Continuation of U.S. patent application Ser. No. 14/972,367, filed Dec. 17, 2015, which claims the benefit of Japanese Patent Application No. 2014-262997, filed Dec. 25, 2014, which are hereby incorporated by reference herein in their entireties.

BACKGROUND OF THE INVENTION

Field of the Invention

The present invention relates to a sheet conveyance apparatus for conveying sheets, and an image forming apparatus having the same.

Description of the Related Art

Hitherto, Japanese Patent Application Laid-Open Publication No. 2013-28465 proposes a sheet feeding apparatus including a plurality of sheet feed cassettes, and a conveyance guide for guiding the sheets conveyed from the plurality of sheet feed cassettes. The conveyance guide is arranged in a pivotable manner, and constitutes different sheet conveyance paths by one side surface and the other side surface of the conveyance guide.

The sheet feeding apparatus has a door that can be opened and closed with respect to an apparatus body to be able to access the conveyance guide, and is arranged so that when the door is closed from a state where the conveyance guide and the door are in an opened state, the door pushes the conveyance guide to a closed state.

However, according to the sheet feeding apparatus taught in the above-mentioned Japanese Patent Application Laid-Open Publication No. 2013-28465, in the state where the door is closed, the conveyance guide is retained in a state leaning against the door, so that when the door is opened, the conveyance guide is opened automatically. Therefore, when the door is opened in a state where a sheet stays in the sheet conveyance path provided in the door side with respect to the conveyance guide, the conveyance guide will lean against the sheet, possibly causing damage to the sheet. Further, the conveyance guide in the opened state may interfere with the treating of the jammed sheet.

SUMMARY OF THE INVENTION

According to a characteristic feature of the present invention, a sheet conveyance apparatus includes a sheet conveyance portion configured to convey a sheet in a sheet conveying direction, a conveyance guide arranged movably between a guide open position and a guide closed position, and configured to guide the sheet conveyed by the sheet conveyance portion at the guide closed position, a door arranged movably between a door open position and a door closed position, and configured to move the conveyance guide from the guide open position to the guide closed position in response to a movement of the door from the door open position to the door closed position, and a first retaining portion and a second retaining portion configured to retain the conveyance guide at the guide closed position in a state where the door is positioned at the door closed position. In a state where the door is positioned at the door open position, the first retaining portion keeps to retain the conveyance guide at the guide closed position and the second retaining portion releases a retention of the conveyance guide at the guide closed position.

Further features of the present invention will become apparent from the following description of exemplary embodiments with reference to the attached drawings.

DESCRIPTION OF THE EMBODIMENTS

First Embodiment

Figure 1:
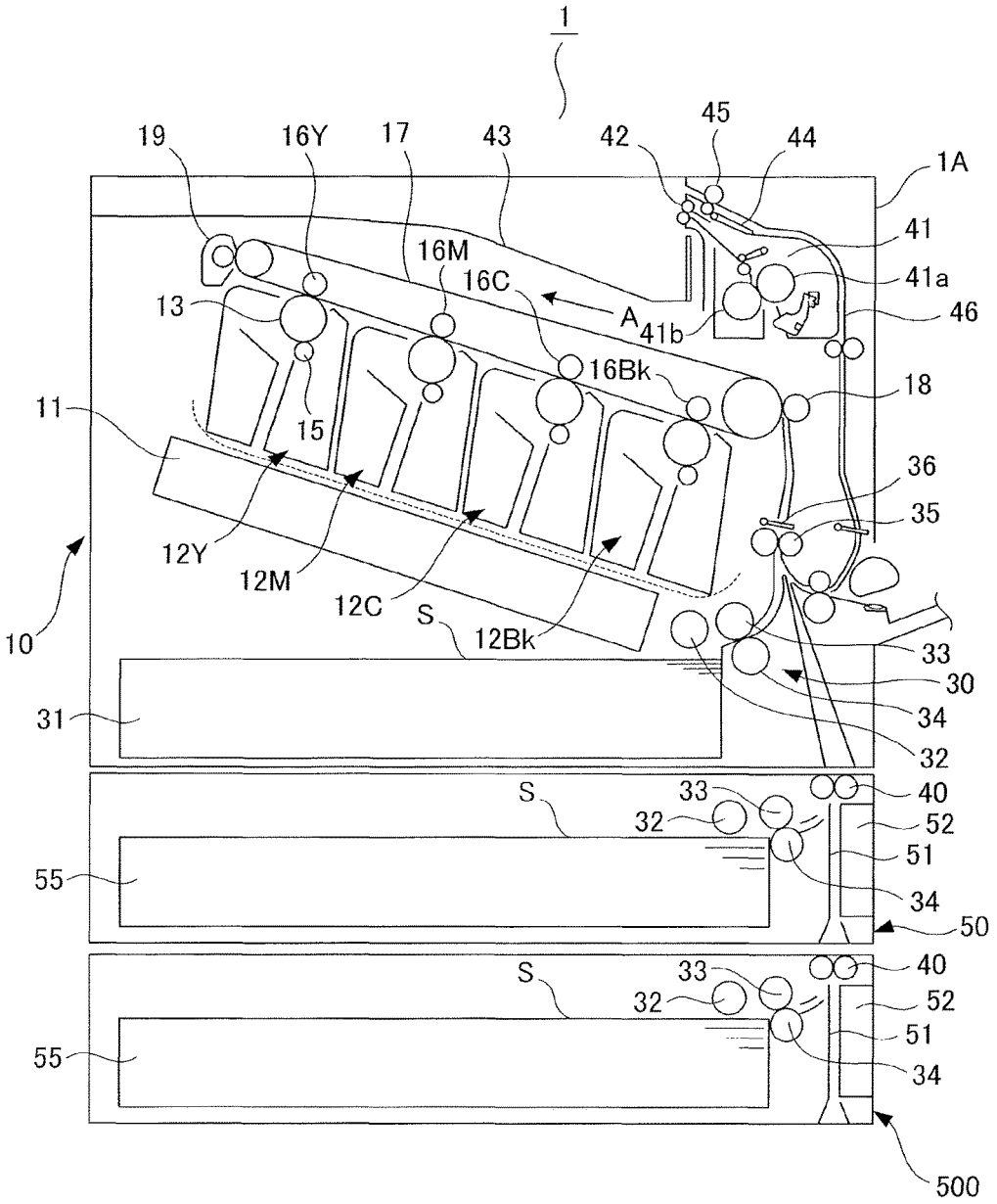
FIG. 1 is an overall cross-sectional view of a printer according to a first embodiment of the present invention.

Now, a first embodiment of the present invention will be described. A printer 1 (image forming apparatus) according to the present embodiment is an electro-photographic laser beam printer for forming four-color toner images. As illustrated in FIG. 1, the printer 1 includes a main body feed portion 30 for feeding stacked sheets, two sheet feeding apparatuses 50 and 500 mounted as optional members at a lower section of a main body 1A of the printer 1, and an image forming portion 10 for forming images on a sheet.

When an image forming command is output to the printer 1, an image forming process by the image forming portion 10 is started based on image information entered from an external computer and the like coupled to the printer 1. The image forming portion 10 includes a scanner unit 11, and four process cartridges 12Y, 12M, 12C and 12Bk for forming four color images of yellow (Y), magenta (M), cyan (C) and black (Bk). The four process cartridges 12Y, 12M, 12C and 12Bk have the same configuration except for the difference in the formed image colors, so that only the image forming process of the process cartridge 12Y will be described, and the descriptions of process cartridges 12M, 12C and 12Bk will be omitted.

The scanner unit 11 irradiates laser beams toward a photosensitive drum 13 of the process cartridge 12Y based on the entered image information. At this time, the photosensitive drum 13 is charged in advance by a charging roller not shown, so that by irradiating laser beams, an electrostatic latent image is formed on the photosensitive drum 13. Thereafter, the electrostatic latent image is developed via a developing roller 15, and a yellow (Y) toner image is formed on the photosensitive drum 13.

Similarly, magenta (M), cyan (C) and black (Bk) toner images are formed on photosensitive drums of process cartridges 12M, 12C and 12Bk. The toner images of respective colors formed on the respective photosensitive drums are transferred by primary transfer rollers 16Y, 16M, 16C and 16Bk to an intermediate transfer belt 17, and conveyed by the intermediate transfer belt 17 rotating toward direction A to a secondary transfer roller 18. The image forming processes of the respective colors are performed at timings set so that the toner images are respectively superposed on the upstream toner image primarily transferred to the intermediate transfer belt 17.

In parallel with the above-described image forming process, a sheet S is selectively fed from the main body feed portion 30 and the sheet feeding apparatuses 50 and 500. For example, when sheets S stacked in a cassette 31 of the main body feed portion 30 are fed via a pickup roller 32, the sheets S are separated one by one by a feed roller 33 and a retard roller 34, and conveyed toward a registration roller 35.

After the skew of the sheet S is corrected by the registration roller 35, the sheet S is conveyed at a predetermined conveyance timing based on a front end position of the sheet S detected by a top sensor 36. A full-color toner image formed on the intermediate transfer belt 17 is transferred to a first surface (front surface) of the sheet S via a secondary transfer bias applied on the secondary transfer roller 18. The residual toner remaining on the intermediate transfer belt 17 is recovered by a cleaning portion 19.

The sheet S to which the toner image has been transferred is subjected to predetermined heat and pressure by a pressure roller 41*a* and a heating roller 41*b* provided on the fixing unit 41, by which the toner is melted and fixed. The sheet S having passed through the fixing unit 41 is discharged on a discharge tray 43 by a discharge roller pair 42.

When forming images on both sides of the sheet S, the sheet S is guided by a switching member 44 to a reverse conveying roller pair 45. When a rear end of the sheet S passes the switching member 44, the reverse conveying roller pair 45 is reversed and the switching member 44 is driven, so that the sheet S is guided to a duplex conveyance path 46. The sheet S having been conveyed to the duplex conveyance path 46 is further conveyed to the registration roller 35, then a toner image is formed on a second surface (rear surface) by the secondary transfer roller 18. When the toner image is fixed by the fixing unit 41, the sheet S having images formed on the first and second surfaces is discharged via the discharge roller pair 42 to the discharge tray 43.

Next, sheet feeding apparatuses 50 and 500 (sheet conveyance apparatuses) will be described with reference to FIG. 2. The sheet feeding apparatus 50 disposed at an upper level and the sheet feeding apparatus 500 disposed at a lower level have the same configurations, so that only the configuration of the sheet feeding apparatus 50 will be described, and the same reference numbers are given to the same components and descriptions thereof are omitted.

The sheet feeding apparatus 50 includes a cassette 55 on which sheets are stacked and drawably disposed with respect to a casing 50A, a sheet feeding portion 100 (sheet conveyance portion) for feeding the sheets stacked on the cassette 55, a conveyance guide 51 for guiding the sheets, and a conveyance roller pair 40. Similar to the main body feed portion 30, the sheet feeding portion 100 includes the pickup roller 32, the feed roller 33, and the retard roller 34. The sheet fed from the cassette 55 is guided on a first conveyance path 54 composed of a guide member 53 and a first conveyance surface 51*d* of the conveyance guide 51 to the conveyance roller pair 40. Then, the sheet is conveyed by the conveyance roller pair 40 toward the registration roller 35.

When a sheet is fed from the sheet feeding apparatus 500 disposed at the lower level, the sheet S fed from the cassette 55 is conveyed via the conveyance roller pair 40 to the sheet feeding apparatus 50 disposed at the upper level. The sheet S is guided on a second conveyance path 66 formed by a second conveyance path composed of a second conveyance surface 51*f* of the conveyance guide 51 and a guide portion 52*e* of a door 52 described later to the conveyance roller pair 40 of the sheet feeding apparatus 50, then conveyed toward the registration roller 35.

Figure 3A:
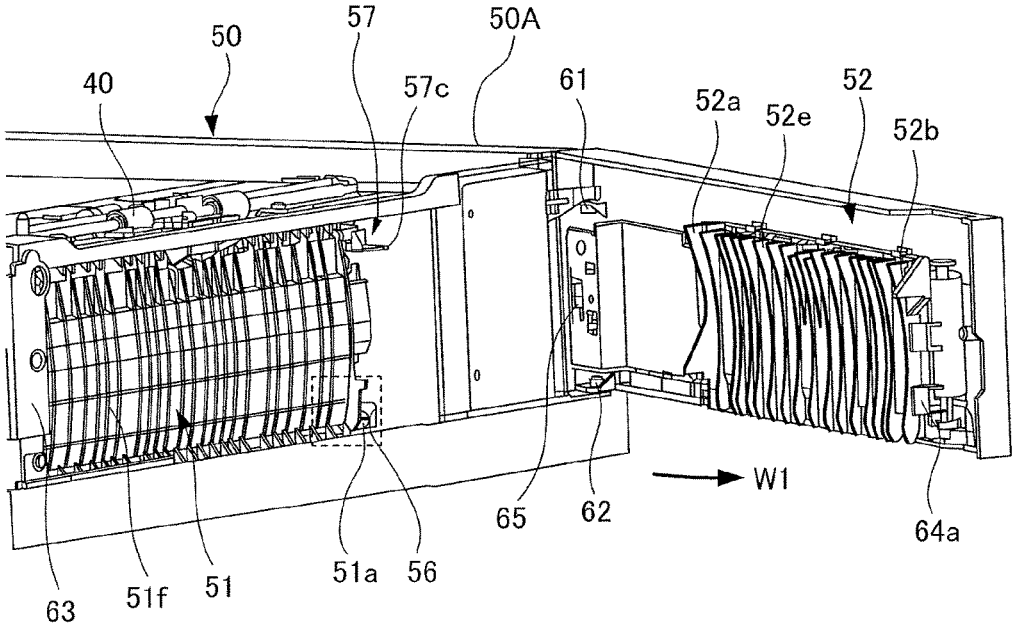
FIG. 3A is a perspective view illustrating a sheet feeding apparatus in a state where a conveyance guide is positioned at a closed position.

Next, the arrangement of the sheet feeding apparatus 50 will be described in detail. As illustrated in FIG. 3A, the sheet feeding apparatus 50 has a door 52 formed pivotably with respect to the casing 50A between an open position (second open position) and a closed position (second close position) around opening and closing shafts (opening and closing axis) 61 and 62 extending in a vertical direction. The door 52 can be moved from the closed position to the open position, and opened toward direction W1 shown in FIG. 3A. The door 52 has a handle 64 attached to an exterior surface (refer to FIG. 5A), and the door is arranged so that by operating the handle 64, an engaging claw 64*a* attached to an interior surface can be pivoted. The opening and closing shafts 61 and 62 are not necessary extended in the vertical direction, and can be extended in an approximately vertical direction tilted by plus or minus 10 degrees with respect to the vertical direction.

The engaging claw 64*a* engages with a door stopper member 63 disposed on the casing 50A, so as to lock the door 52 in the closed state. The door 52 is biased with slight pressure toward direction W1 (direction toward which the door 52 opens) by a door spring 65, so that by operating the handle 64 when the door 52 is at the closed state, the engagement of the engaging claw 64*a* can be released and the door can be opened easily.

The above-mentioned guide portion 52*e*, a guide cam 52*a* (guide surface) arranged on one end side of the guide portion 52*e*, and a lock cam surface 52*b* (tapered surface) arranged on the other end side of the guide portion 52*e* are provided on the interior surface of the door 52. The guide portion 52*e* is composed of a plurality of plate members arranged vertically in a comb-like manner, and constitutes the second conveyance path 66 together with the second conveyance surface 51*f* of the conveyance guide 51.

The guide cam 52*a* is formed in a curved surface shape with the center area dented, and arranged close to the opening and closing shafts 61 and 62 with respect to the lock cam surface 52*b*. The lock cam surface 52*b* has a tapered shape slanted toward the direction in which the door 52 closes (direction opposite to the direction W1).

Figure 3B:
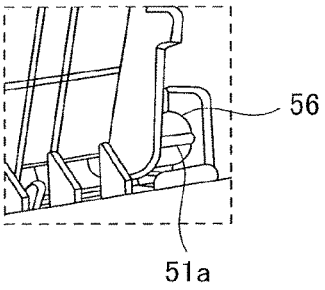
FIG. 3B is an enlarged view of a dashed line portion of FIG. 3A.

On the other hand, as shown in FIGS. 3A and 3B, the conveyance guide 51 has a rotating shaft 51*a* passed through a rotation hole 56 formed on the casing 50A, and arranged in a horizontal direction orthogonal to the opening and closing shafts 61 and 62. The conveyance guide 51 is arranged pivotably around the rotating shaft 51*a* between a closed position (first closed position) and an open position (first open position). The rotating shaft 51a is not necessarily extended in the vertical direction, and can be extended in an approximately vertical direction tilted by plus or minus 10 degrees with respect to the vertical direction.

At least a portion of one side (inner side) surface of the conveyance guide 51 constitutes a portion of the first conveyance path 54 in a case where the conveyance guide 51 is positioned at the close position. Furthermore, at least a portion of the other side (outer side) surface of the conveyance guide 51 constitutes a portion of the second conveyance path 66 in a case where the conveyance guide 51 is positioned at the closed position. The conveyance guide 51 moves by its own weight from the closed position to the open position by having an operation lever 57*c* (operation portion) described later operated. That is to say, the center of gravity of the conveyance guide 51 is positioned closer to the door 52 than the rotating shaft 51*a*. By positioning the conveyance guide 51 to the open position, the first conveyance path 54 disposed on the inner side of the apparatus can be exposed, so that a jammed sheet staying in the first conveyance path 54 can be accessed, for example. FIG. 3A illustrates a state where the conveyance guide 51 is at the closed position, and FIG. 4 illustrates a state where the conveyance guide 51 is at the open position.

Figure 4:
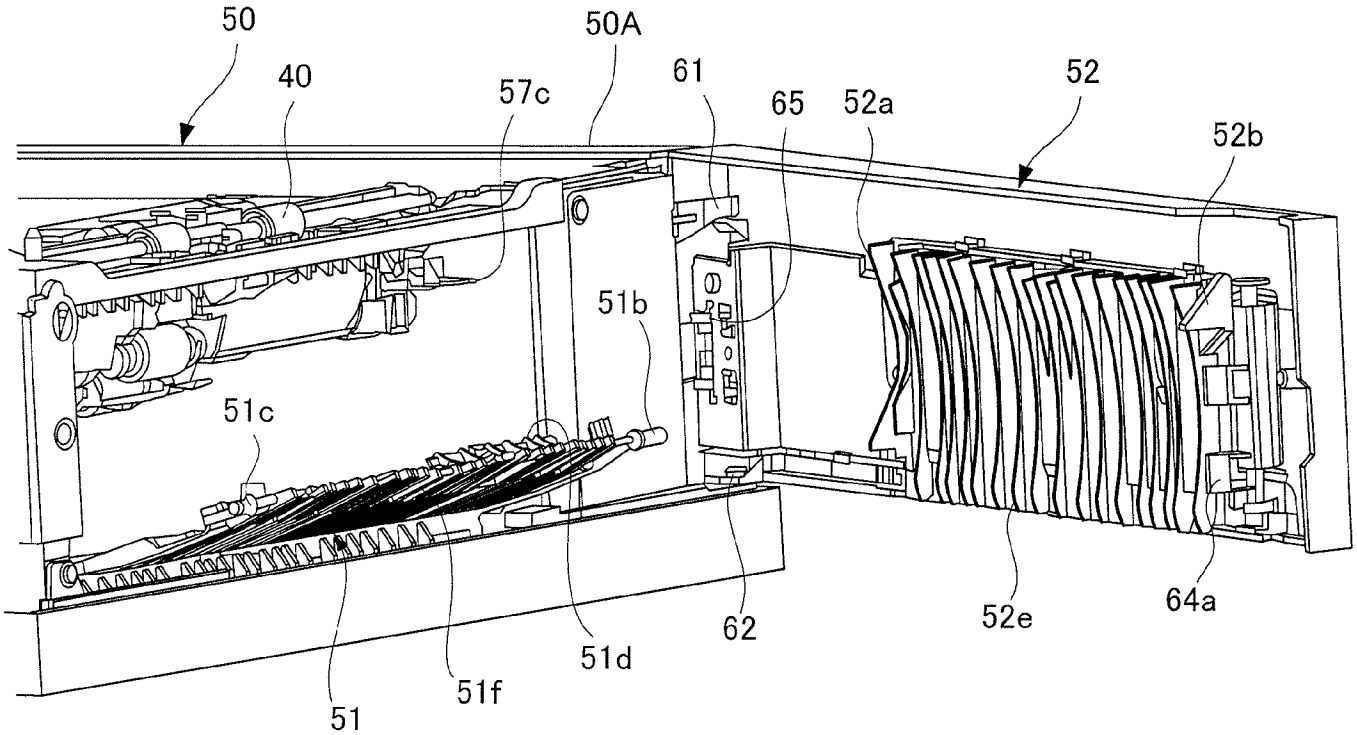
FIG. 4 is a perspective view illustrating the sheet feeding apparatus in a state where the conveyance guide is positioned at an open position.
Figure 5A:
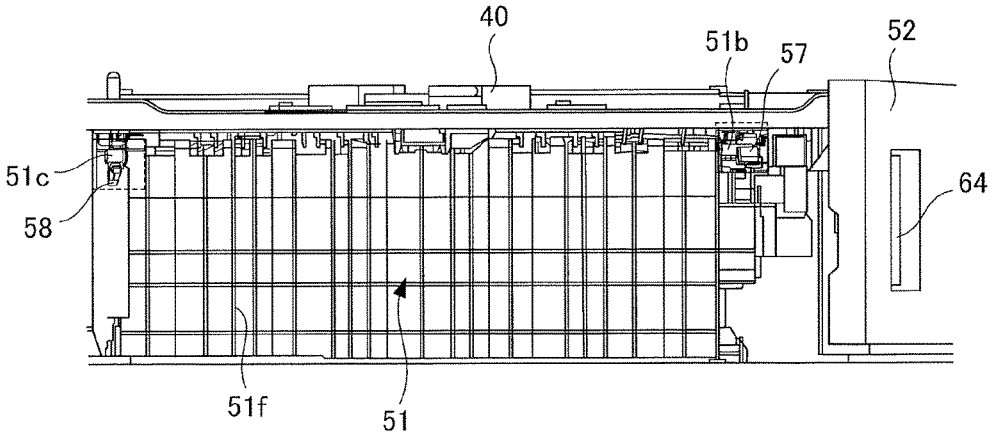
FIG. 5A is a side view illustrating the sheet feeding apparatus in a state where the conveyance guide is positioned at the closed position.
Figure 5B:
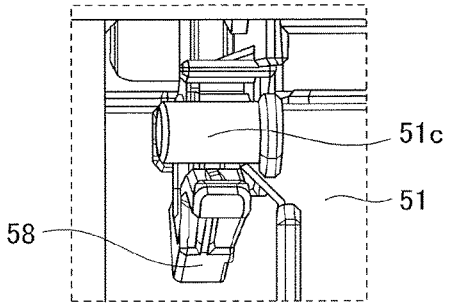
FIG. 5B is an enlarged view of a dashed line portion on the left side of FIG. 5A.
Figure 5C:
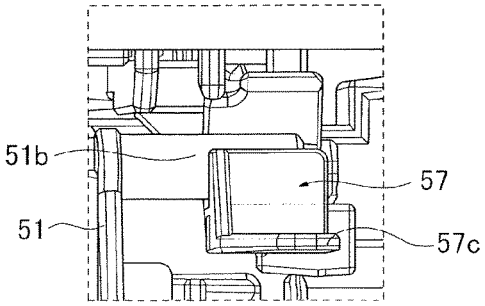
FIG. 5C is an enlarged view of a dashed line portion on the right side of FIG. 5A.

As illustrated in FIGS. 4 and 5A, the conveyance guide 51 has a cylindrical rear engage portion 51*b* (engage portion) disposed at an end portion close to the opening and closing shafts 61 and 62, and has a cylindrical front engage portion 51*c* on the opposite end portion intervening the first conveyance surface 51*d* and the second conveyance surface 51*f* By having the rear engage portion 51*b* and the front engage portion 51*c* locked (retained) by a rear hook member 57 (hook member) and a front hook member 58 (second retaining portion) disposed respectively on the casing 50A, the conveyance guide 51 can be retained at the closed position. The front hook member 58 is arranged at a position farther from the opening and closing shafts 61 and 62 than the rear hook member 57 in the axial direction of the rotating shaft 51*a*.

Figure 6A:
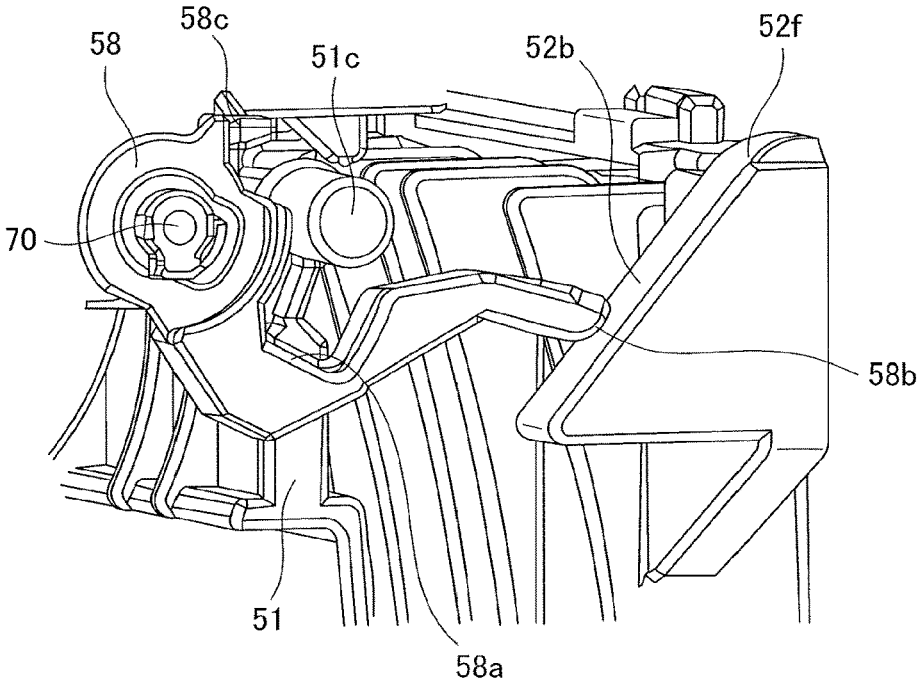
FIG. 6A is a perspective view illustrating a state where the conveyance guide is not locked by a front hook member.

As illustrated in FIG. 6A, the front hook member 58 has an engagement portion 58*a* supported pivotably by a shaft (axis) 70 formed on the casing 50A in parallel with the rotating shaft 51*a* and capable of being engaged with the front engage portion 51*c*, and a pointed portion 58*b* (abutting portion) capable of sliding against the lock cam surface 52*b*. Further, the front hook member 58 pivots downward around the shaft 70 by its own weight, but the pivoting movement is regulated by a regulation portion 58*c* so that the pointed portion 58*b* is positioned in an upper area than a lower end portion of the lock cam surface 52*b*.

Figure 7:
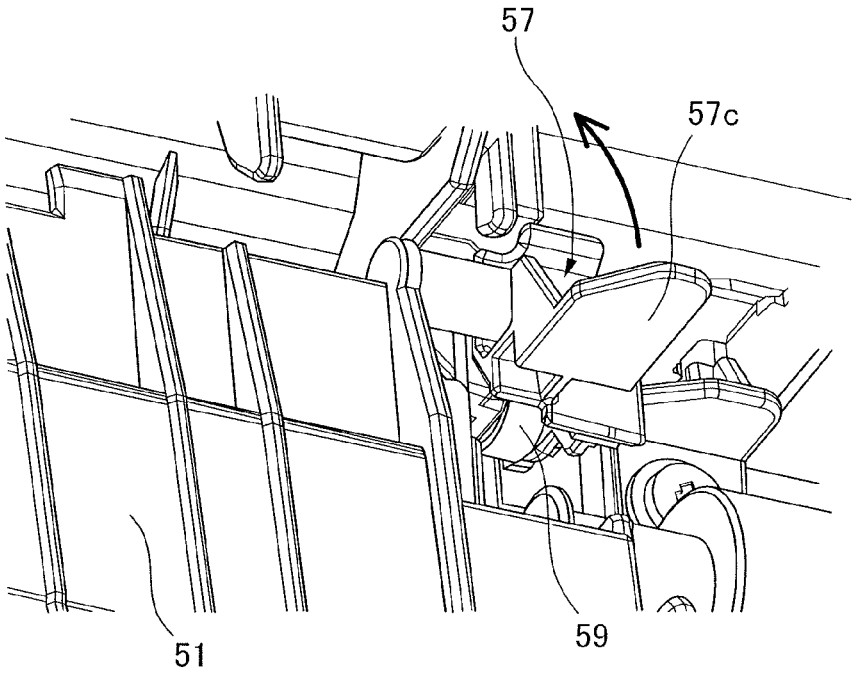
FIG. 7 is a perspective view illustrating an operation lever and a lock spring of a rear hook member.
Figure 10A:
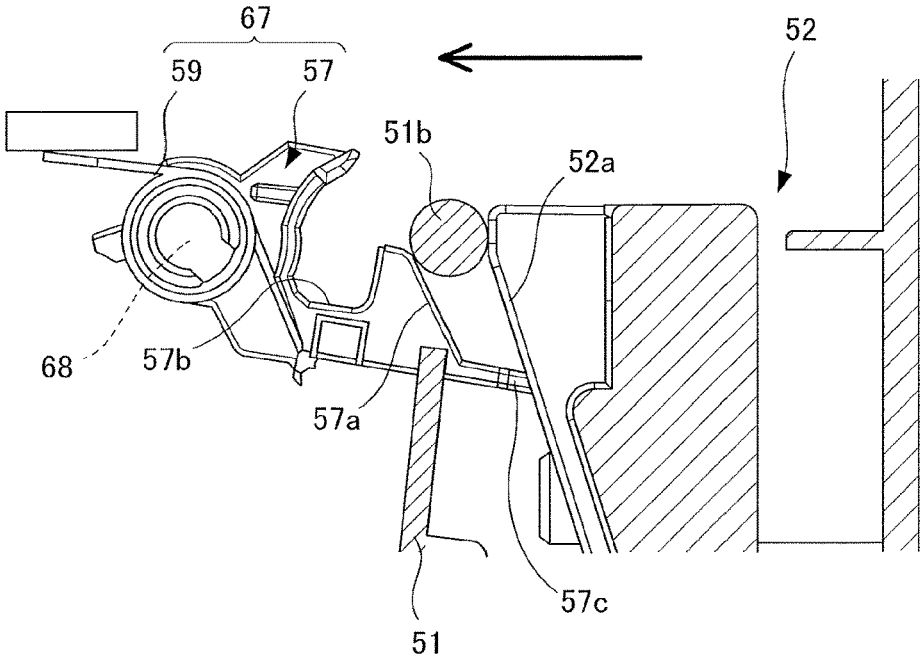
FIG. 10A is a front view illustrating a state where the rear engage portion is abutted against the rear hook member.
Figure 10B:
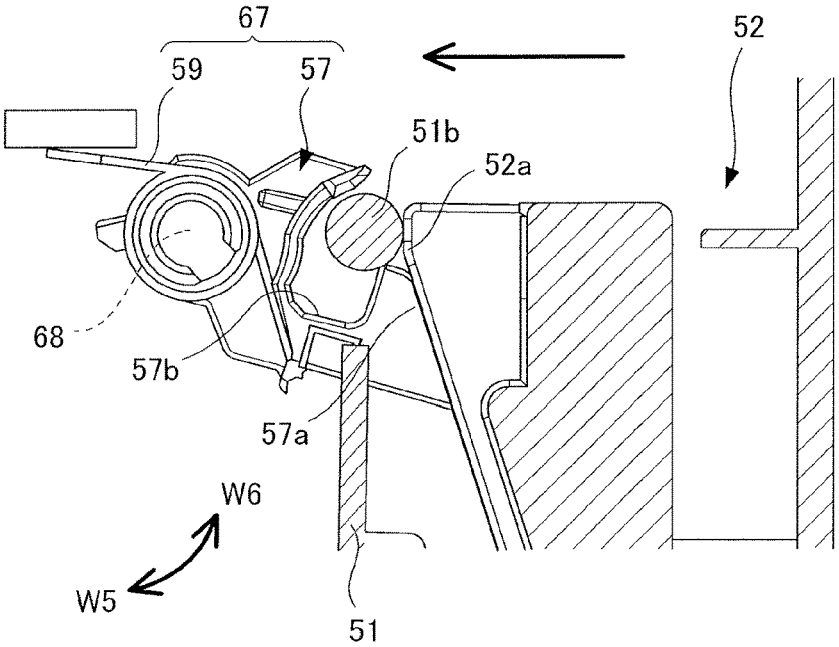
FIG. 10B is a front view illustrating a state where the rear hook member is pushed downward by the rear engage portion.

As shown in FIGS. 10A, 10B and 7, the rear hook member 57 is supported pivotably by a shaft (axis) 68 formed on the casing 50A in parallel with the rotating shaft 51*a*, and includes an abutting surface 57*a* abutting against the rear engage portion 51*b*, and an engagement portion 57*b* capable of engaging with the rear engage portion 51*b*. The rear hook member 57 includes the operation lever 57*c*, and when the lever 57*c* is operated downward, the engagement between the engagement portion 57*b* and the rear engage portion 51*b* is released, and the conveyance guide 51 is moved from the close position to the open position. The rear hook member 57 is biased upward (direction of arrow shown in FIG. 7) by a lock spring 59 (biasing member) mounted to the shaft 68, and the rear hook member 57 together with the lock spring 59 constitute a lock unit 67 (retaining portion) locking the conveyance guide 51 at the close position.

Next, we will describe the operation for moving the conveyance guide 51 from the closed position to the open position. At first, the user operates the handle 64 and opens the door 52 by the biasing force of the door spring 65 or the force applied by the user. When opening the door 52, the front hook member 58 slides the pointed portion 58*b* against the lock cam surface 52*b* while pivoting downward by its own weight, and is positioned at a position illustrated in FIG. 6A by the regulation portion 58*c*. Thereby, the engagement portion 58*a* of the front hook member 58 is separated from the front engage portion 51*c* of the conveyance guide 51, and the lock of the front engage portion 51*c* is released.

Figure 2:
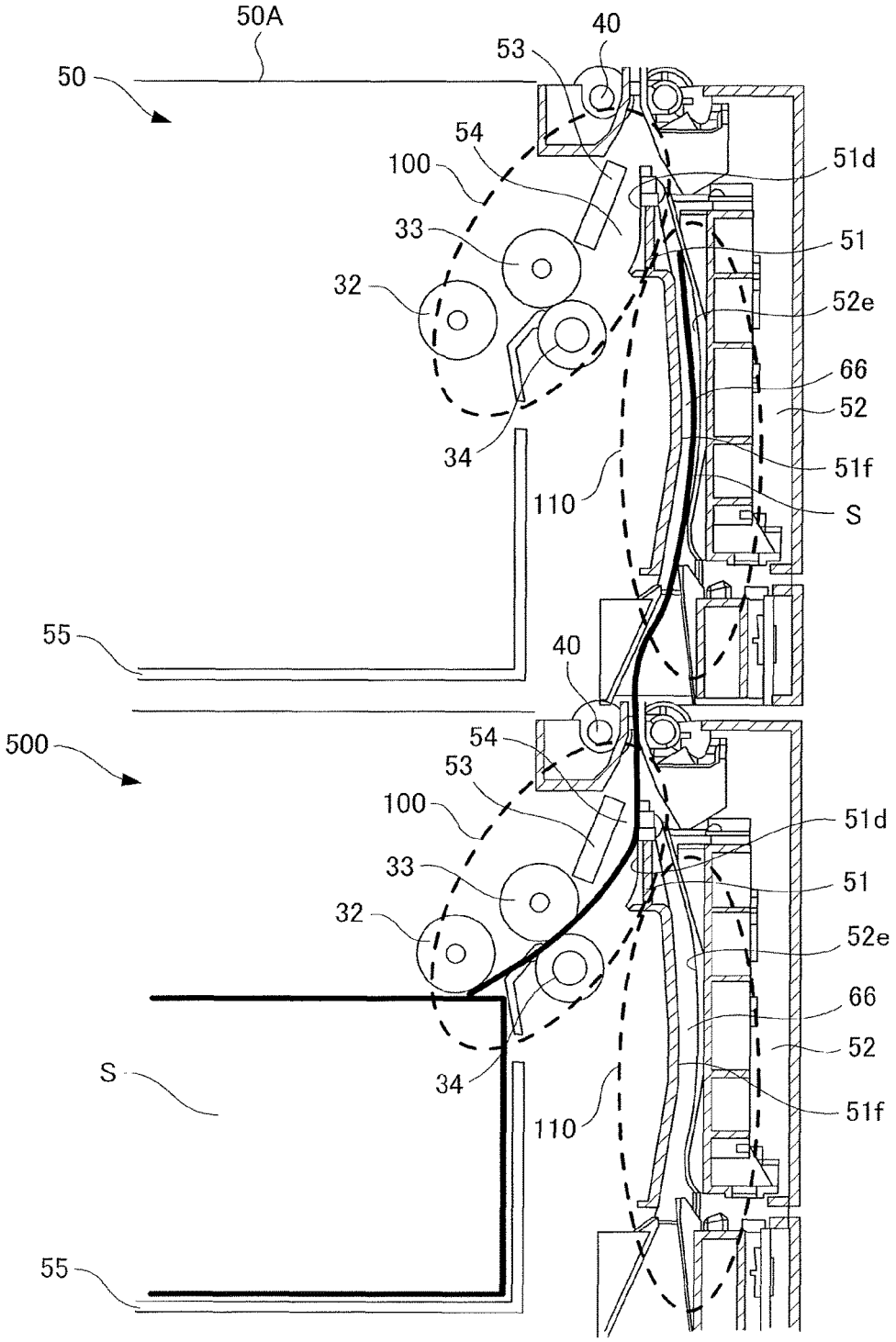
FIG. 2 is a cross-sectional view illustrating a conveyance path when a sheet is fed from a sheet feeding apparatus at a lower level.

In this state, a wide space 110 can be secured around the second conveyance path 66 illustrated in FIG. 2, and the jamming caused in the second conveyance path 66 can be treated easily.

Figure 8A:
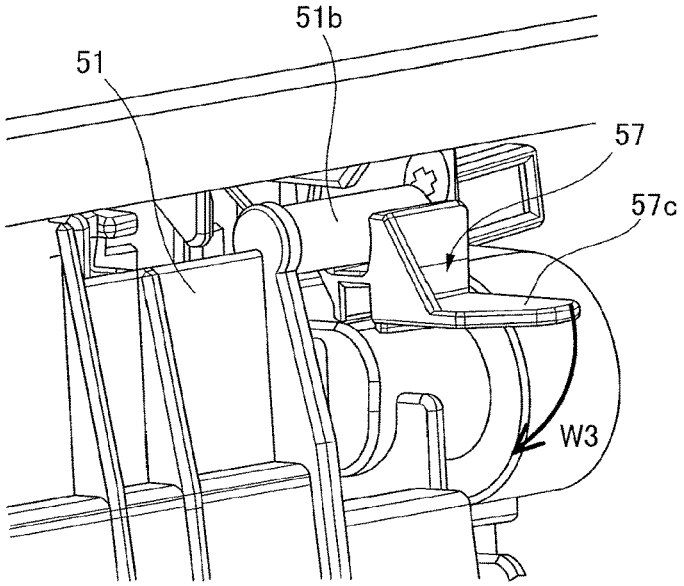
FIG. 8A is a perspective view illustrating a rear hook member before having the operation lever pivoted.
Figure 8B:
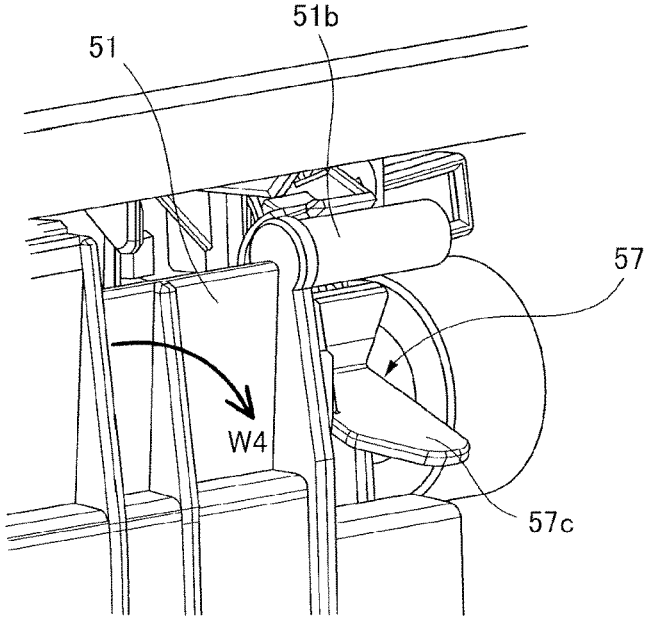
FIG. 8B is a perspective view illustrating a rear hook member after the operation lever is pivoted.

As illustrated in FIG. 8A, the user pivots the operation lever 57*c* of the rear hook member 57 downward (in the direction of W3), resisting against the biasing force of the lock spring 59. Then, the engagement portion 57*b* of the rear hook member 57 is separated from the rear engage portion 51*b* of the conveyance guide 51, and the lock of the rear engage portion 51*b* is released. Then, the conveyance guide 51 pivots downward (in the direction of W4) illustrated in FIG. 8B by its own weight. Thereby, a wide space can be secured for the sheet feeding portion 100 around the first conveyance path 54 illustrated in FIG. 2, and the jamming caused in the first conveyance path 54 can be treated easily.

Figure 9A:
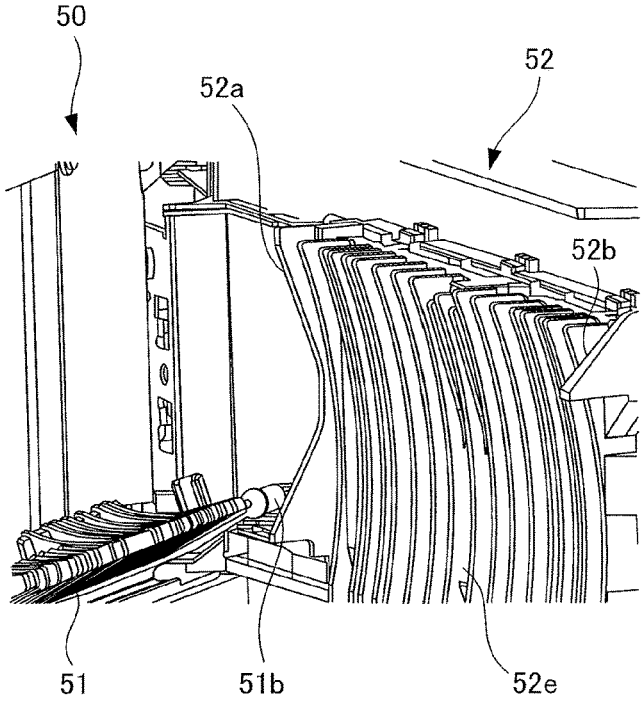
FIG. 9A is a perspective view illustrating a state where a guide cam is abutted against a rear engage portion.
Figure 9B:
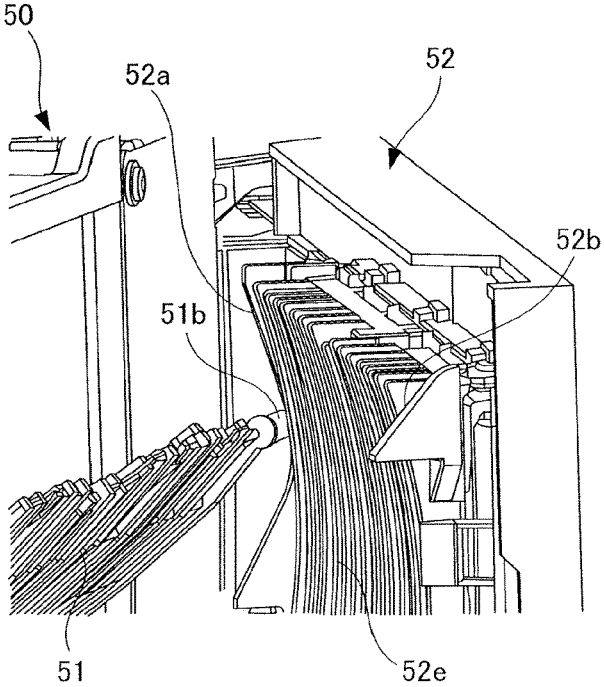
FIG. 9B is a perspective view illustrating a state where the rear engage portion is guided on the guide cam.

Next, we will describe the operation performed when closing the door 52 in a state where the conveyance guide 51 is at the open position. When the user performs an operation to close the door 52, as illustrated in FIG. 9A, the rear engage portion 51*b* of the conveyance guide 51 at the open position is abutted against the guide cam 52*a* formed on the door 52. The guide cam 52*a* is formed in a curved shape to fit the pivoting locus of the door 52, and as illustrated in FIG. 9B, the rear engage portion 51*b* is guided by the guide cam 52*a* along with the closing operation of the door 52, and the conveyance guide 51 moves toward the closed position. The rear engage portion 51*b* of the conveyance guide 51 at the open position is positioned in an upper area than a lower end of the guide cam 52*a*.

When the conveyance guide 51 pivots for a predetermined amount, as illustrated in FIG. 10A, the rear engage portion 51*b* of the conveyance guide 51 abuts against the abutting surface 57*a* of the rear hook member 57. The operation lever 57*c* is formed so as not to interfere with the rear engage portion 51*b* when the conveyance guide 51 pivots from the open position toward the closed position. When the conveyance guide 51 pivots further toward the close position, as illustrated in FIG. 10B, the rear engage portion 51*b* pushes the rear hook member 57 downward (direction W5) against the biasing force of the lock spring 59. Thereafter, when the rear engage portion 51*b* of the conveyance guide 51 moves beyond the abutting surface 57*a*, the rear hook member 57 pivots upward (direction W6) by the lock spring 59, and the rear engage portion 51*b* of the conveyance guide 51 is locked by the engagement portion 57*b* of the rear hook member 57.

Figure 6B:
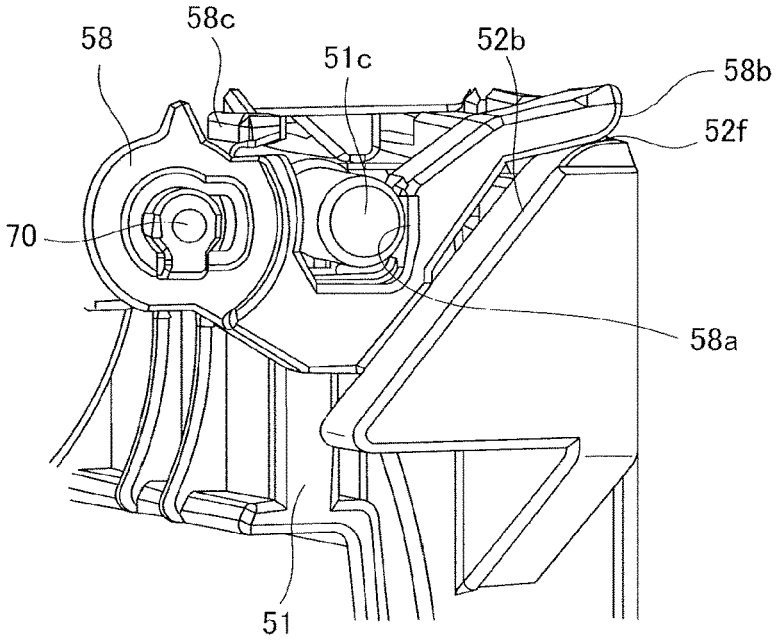
FIG. 6B is a perspective view illustrating a state where the conveyance guide is locked by the front hook member.

When the door is closed further in this state, as illustrated in FIG. 6A, the lock cam surface 52*b* formed on the door 52 is abutted against the pointed portion 58*b* of the front hook member 58. Then, the front hook member 58 is scooped up by the lock cam surface 52*b*, and the pointed portion 58*b* is guided to a retention surface 52*f* formed successively on an upper portion of the lock cam surface 52*b*. As illustrated in FIG. 6B, at a position where the pointed portion 58*b* has moved upon the retention surface 52*f*, the front engage portion 51*c* of the conveyance guide 51 positioned at the closed position is locked by the engagement portion 58*a* of the front hook member 58. Thereafter, the engaging claw 64*a* of the door 52 is engaged with the door stopper member 63, and the closing operation of the door 52 is completed.

The above-described closing operation of the door 52 is performed in a state where the conveyance guide 51 is positioned at the open position, but the closing operation of the door 52 is also possible in a state where the conveyance guide 51 is positioned at the close position.

According to the present embodiment, by performing an opening operation of the door 52, the lock by the front hook member 58 is released automatically, and the conveyance guide 51 is locked (retained) at the close position only by the rear hook member 57. Then, by having the user operate the operation lever 57*c* of the rear hook member 57, the conveyance guide 51 can be moved from the closed position to the open position in a single operation. Therefore, when the door 52 is in the closed state, the conveyance guide 51 is locked stably by the front hook member 58 and the rear hook member 57 at front and rear positions to realize a good sheet feeding performance, and at the same time, the conveyance guide 51 can be opened easily, so that good operability can be realized.

Further, the conveyance guide 51 can be opened and closed selectively by a simple composition, so that it becomes possible to prevent the conveyance guide 51 from falling on the jammed sheet in the second conveyance path 66 and damaging the sheet, and to improve the treating performance of the jammed sheet in the second conveyance path 66.

Further, even when the conveyance guide 51 is positioned at the open position, the conveyance guide 51 can be locked at the closed position by performing a closing operation of the door 52, so that advantageous operability is realized.

In the present embodiment, the conveyance guide 51 is composed in a lockable manner by the front hook member 58 and the rear hook member 57, but it is possible to adopt an arrangement where the front hook member 58 is omitted and the rear hook member 57 locks the conveyance guide 51 alone. Thereby, the number of components can be reduced and costs can be cut down. Any arrangement for locking the conveyance guide 51 can be adopted, without being restricted to the hook member and the cylindrical engage portion.

Further, the present invention is not restricted to the sheet feeding apparatuses 50 and 500 provided as optional members, and can be applied to the main body feed portion 30 or to a manual sheet feed apparatus.

Second Embodiment

Figure 11A:
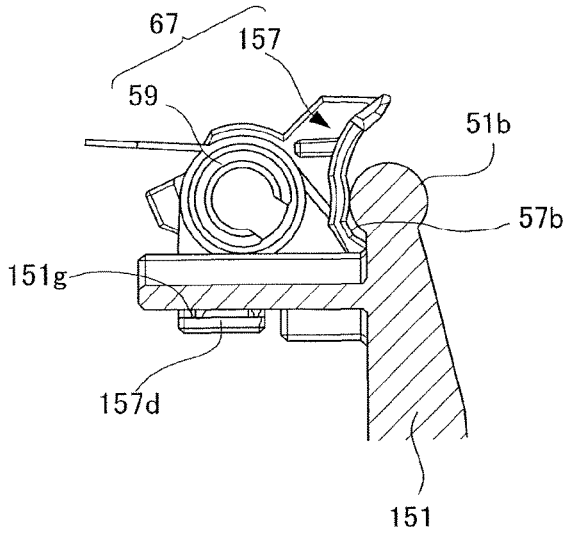
FIG. 11A is a front view illustrating the conveyance guide and the rear hook member according to the second embodiment of the present invention, showing a state where the rear hook member is not pivoted.

Next, a second embodiment of the present invention will be described, wherein regarding the arrangements similar to the first embodiment, either the illustration thereof are omitted, or the same reference numbers are assigned in the drawings and descriptions thereof are omitted. As illustrated in FIG. 11A, a conveyance guide 151 for guiding sheets has a rear engage portion 51*b*, and a pressed portion 151*g* formed to protrude toward the casing 50A.

A rear hook member 157 (hook member) includes the abutting surface 57*a*(refer to FIG. 10A) abutting against the rear engage portion 51*b*, the engagement portion 57*b*capable of engaging with the rear engage portion 51*b*, the operation lever 57*c*, and a pressure portion 157*d*. In the state where the conveyance guide 151 is positioned at the closed position and the conveyance guide 151 is locked by the rear hook member 157, a fixed clearance is provided to the pressed portion 151*g* and the pressure portion 157*d*.

Figure 11B:
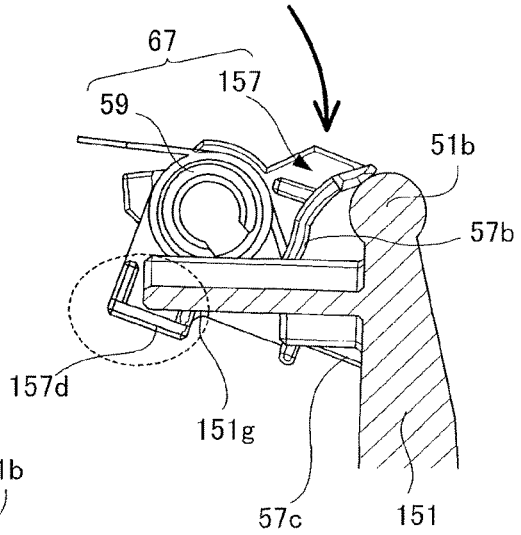
FIG. 11B is a front view illustrating a state where the rear hook member is pivoted and abutted against the conveyance guide.
Figure 11C:
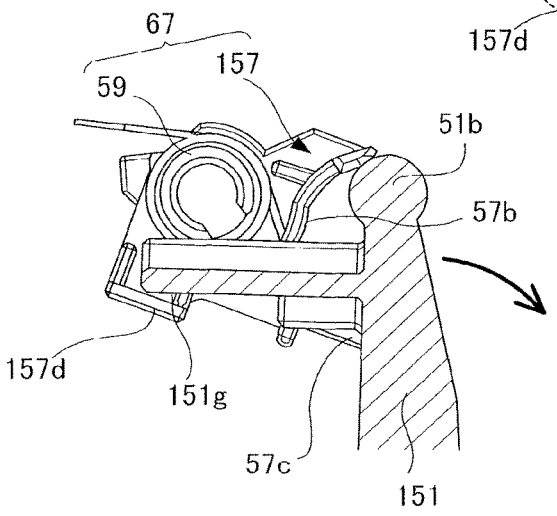
FIG. 11C is a front view illustrating a state where the rear hook member is pivoted and pressing the conveyance guide.

The present embodiment is arranged as described above, so that as illustrated in FIG. 11B, when the operation lever 57*c* is operated and the rear hook member 157 pivots in the direction of the arrow, the pressure portion 157*d* of the rear hook member 157 is abutted against the pressed portion 151*g* of the conveyance guide 151. By having the pressure portion 157*d* press the pressed portion 151*g*, the conveyance guide 151 moves toward the open position.

As described, even if it is difficult to smoothly move the conveyance guide 151 by its own weight to the open position due to design limitations and the like, it becomes possible to move the conveyance guide 151 smoothly to the open position.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

What is claimed is:

1. A sheet conveyance apparatus comprising:

a sheet conveyor configured to convey a sheet in a sheet conveying direction;

a conveyance guide arranged movably between a guide open position and a guide closed position, and configured to guide the sheet conveyed by the sheet conveyor at the guide closed position;

a door arranged movably between a door open position and a door closed position, and configured to press the conveyance guide so as to move the conveyance guide from the guide open position to the guide closed position in response to a movement of the door from the door open position to the door closed position;

a first retainer configured to engage the conveyance guide so as to retain the conveyance guide, and a second retainer disposed in a position different from the first retainer and configured to engage the conveyance guide so as to retain the conveyance guide, wherein in a state where the door is positioned at the door closed position, the first and second retainers retain the conveyance guide at the guide closed position, and wherein in a state where the door is positioned at the door open position, the first retainer retains the conveyance guide at the guide closed position and the second retainer does not retain the conveyance guide at the guide closed position.

2. The sheet conveyance apparatus according to claim 1, wherein the first retainer and the second retainer are configured to retain the conveyance guide at the guide closed position as the door moves the conveyance guide from the guide open position to the guide closed position.

3. The sheet conveyance apparatus according to claim 1, wherein a center of gravity of the conveyance guide is positioned such that the conveyance guide is urged by its own weight toward the door in a case where the door is positioned at the door closed position, and wherein the conveyance guide moves by its own weight from the guide closed position to the guide open position in response to the first retainer releasing the retention of the conveyance guide in a case where the door is positioned at the door open position.

4. The sheet conveyance apparatus according to claim 1, wherein the conveyance guide guides the sheet conveyed by the sheet conveyor in a vertical direction at the guide closed position and is arranged to be pivotable around a pivot axis, positioned at a downside of the conveyance guide, extending in a horizontal direction, and the first retainer and the second retainer are arranged at an upside of the conveyance guide at the guide closed position and arranged along a direction intersecting with the sheet conveying direction.

5. The sheet conveyance apparatus according to claim 1, wherein the door is arranged to be pivotable around a pivot axis extending in a vertical direction, and the conveyance guide is moved from the guide open position to the guide closed position in response to a movement of the door from the door open positon to the door closed position, and is retained by the first retainer and the second retainer at the guide closed position in a case where the door is positioned at the door closed position.

6. The sheet conveyance apparatus according to claim 1, wherein the conveyance guide is arranged to be pivotable around a pivot axis, the first retainer comprises a first hook member pivotable around an axis parallel with the pivot axis, a biasing member biasing the first hook member, and an engage portion engaging with the first hook member biased by the biasing member in a case where the conveyance guide is positioned at the guide closed position, and the conveyance guide is retained at the guide closed position by an engagement of the engage portion and the first hook member biased by the biasing member.

7. The sheet conveyance apparatus according to claim 6, wherein the first retainer comprises an operation portion configured to release an engagement of the first hook member and the engage portion against a biasing force of the biasing member so as to move the conveyance guide from the guide closed position to the guide open position in a state where the door is positioned at the door open position.

8. The sheet conveyance apparatus according to claim 6, wherein the engage portion is provided on the conveyance guide, the first hook member is provided on a casing of the sheet conveyance apparatus, and the door comprises a guide surface configured to guide the conveyance guide from the guide open position to the guide closed position through the engage portion and to engage the engage portion with the first hook member in response to a movement of the door from the door open position to the door closed position.

9. The sheet conveyance apparatus according to claim 1, wherein the conveyance guide is arranged to be pivotable around a pivot axis, the second retainer comprises a second hook member pivotable around an axis parallel to the pivot axis, and an engage portion engaging with the second hook member in a case where the conveyance guide is positioned at the guide closed position, and the second hook member is released from the engage portion by its own weight in a state where the door moves from the door closed position to the door open position.

10. The sheet conveyance apparatus according to claim 9, wherein the engage portion is provided on the conveyance guide, the second hook member is provided on a casing of the sheet conveyance apparatus, the door comprises a cam surface capable of sliding against the second hook member, and the second hook member is pivoted by the engage portion sliding against the cam surface in response to a movement of the door from the door open position to the door closed position, and keeps an engagement with the engage portion by being supported on the cam surface at the guide closed position.

11. The sheet conveyance apparatus according to claim 1, wherein the conveyance guide is arranged to be pivotable around a pivot axis extending in a horizontal direction, the door is arranged pivotable around a pivot axis extending in a vertical direction, and while the door is moved from the door open position to the door closed position, the door pushes the conveyance guide so that the conveyance guide moves from the guide open position to the guide closed position, and the conveyance guide is retained by the first retainer and the second retaining retainer at the guide closed position.

12. The sheet conveyance apparatus according to claim 1, wherein the conveyance guide comprises a first side surface and a second side surface opposite to the first side surface, the first side surface constitutes a portion of a first conveyance path, and the second side surface constitutes a portion of a second conveyance path, the first conveyance path is arranged on a more inner side of the apparatus than the second conveyance path, and the first conveyance path is exposed as the conveyance guide moves to the guide open position.

13. An image forming apparatus comprising:

the sheet conveyance apparatus as set forth in claim 1; and an image forming portion configured to form an image on a sheet conveyed by the sheet conveyance apparatus.

14. An image forming apparatus comprising:

a sheet feeding apparatus comprising a sheet feeding portion to feed a sheet, and the sheet conveyance apparatus as set forth in claim 1 to convey the sheet fed by the sheet feeding portion; and an image forming portion provided in a main body and configured to form an image on the sheet conveyed by the sheet conveyance apparatus, wherein the sheet feeding apparatus is provided as an optional member at a lower section of the main body.

* * * * *